US006089413A

United States Patent [19]

Riney et al.

[11] Patent Number: 6,089,413

[45] Date of Patent: Jul. 18, 2000

[54] LIQUID DISPENSING AND RECIRCULATING MODULE

[75] Inventors: John M. Riney, Suwanee; Roger A. Ziecker, Lawrenceville, both of Ga.

[73] Assignee: Nordson Corporation, Westlake, Ohio

[21] Appl. No.: 09/153,672

[22] Filed: Sep. 15, 1998

[51] Int. Cl.[7] ..... B65D 88/54

[52] U.S. Cl. ..... 222/318; 504/559

[58] Field of Search ..... 222/318, 504, 222/518, 559; 239/124, 127, 125

[56] References Cited

U.S. PATENT DOCUMENTS

| | | | |
|---|---|---|---|
| 4,687,137 | 8/1987 | Boger et al. | 239/124 |
| 4,850,514 | 7/1989 | Scholl et al. | 222/318 X |
| 5,277,344 | 1/1994 | Jenkins | 222/518 X |
| 5,407,101 | 4/1995 | Hubbard | 222/504 X |
| 5,458,684 | 10/1995 | Miller et al. | 222/318 X |
| 5,620,139 | 4/1997 | Ziecker | 239/124 |

*Primary Examiner*—Kevin Shaver
*Assistant Examiner*—Thach H. Bui
*Attorney, Agent, or Firm*—Wood, Herron & Evans, L.L.P.

[57] ABSTRACT

A liquid dispensing module for alternately dispensing and recirculating liquid including a module body having a valve stem mounted for reciprocating movement within a main passage of the body. The valve stem includes first and second valve members for respectively engaging first and second valve seats in the main passage. A recirculation passage communicates with the main passage. When the valve stem is in a dispensing position, liquid is prevented from flowing into the recirculation passage and instead flows out of one end of the module. However, when the valve stem is in a recirculation position, liquid is prevented from flowing out of the module and instead enters the recirculation passage where it may flow back to a main pump or supply in a recirculation loop. Apparatus and methods incorporating the liquid dispensing module are further described and encompass similar concepts.

37 Claims, 3 Drawing Sheets

LIQUID DISPENSING AND RECIRCULATING MODULE

FIELD OF THE INVENTION

The present invention generally relates to liquid dispensing apparatus and, more specifically, liquid dispensing apparatus such as hot melt adhesive dispensing equipment having both a dispensing mode and a recirculating mode.

BACKGROUND OF THE INVENTION

In many liquid dispensing systems, it is necessary to continuously recirculate the liquid in the system when the system is not in a dispensing mode. For example, in hot melt adhesive dispensing equipment employing multiple dispensing valves, it is often necessary to use two separate hydraulic valves for each stream of dispensed adhesive. These valves are typically mounted to a manifold with one being used to dispense liquid and the other being used to recirculate the liquid. The two valves operate in opposite phases or cycles and typically require separate activation signals. The dispensing valve applies adhesive to the substrate while the recirculation valve is closed and, when the dispensing valve is closed, the recirculation valve is opened to recirculate adhesive back to a supply tank.

Problems associated with dispensing systems such as described above therefore relate to the need for specialized recirculation plates and recirculation valves or modules mounted on the manifold. This is a particular problem both in terms of the added cost associated with the recirculation plates and valves or modules as well as the larger manifolds required to accommodate these additional components. Further, separate control of the dispensing and recirculation valves requires that timing considerations be taken into account. This may require additional timers and/or other control components.

Other valves exist which allow for both a dispensing and recirculation function to be performed by a single valve. However, these valves may require manual operation to changeover between a dispensing mode and a recirculation mode or may have various other drawbacks which limit their availability and practicality in many situations.

For these and other reasons and to solve various problems in this area of technology, it would be desirable to provide a liquid dispensing module that eliminates various extra recirculation components, allows for a reduced manifold size, and generally reduces the number of flow control components and costs typically associated with liquid dispensing and recirculating systems.

SUMMARY OF THE INVENTION

The present invention overcomes the foregoing and other shortcomings of previous liquid dispensing systems and methods requiring alternating dispensing and recirculating modes of operation. While the invention will be described in connection with certain preferred features, it will be understood that the invention is not limited to the specific features referred to herein. On the contrary, the invention includes all alternatives, modifications and equivalents as may be included within the spirit and scope of the present invention.

The present invention generally relates to a liquid dispensing module for alternately dispensing and recirculating liquid. The module includes a module body having a main passage with an axis and communicating with a liquid inlet. The main passage also includes a liquid outlet extending generally along the axis at one end of the main passage, as well as first and second valve seats. The first valve seat is disposed on an upstream side of the liquid outlet, while the second valve seat is disposed on an upstream side of the first valve seat. A valve stem having first and second ends is mounted for reciprocating movement within the main passage along the axis and includes first and second valve members. The first valve member is preferably on the first end of the valve stem and selectively engages the first valve seat to prevent liquid flow through the liquid outlet. The second valve member is disposed on the valve stem between the first valve member and the second end of the valve stem for selectively engaging the second valve seat. A recirculation passage communicates with the main passage and receives liquid flow past the second valve member when the first valve member is engaged with the first valve seat and the second valve member is disengaged from the second valve seat.

The main passage in the module body is essentially divided into two chambers or sections separated by the second valve seat. One chamber may be referred to as the dispensing chamber and is defined between and the first and second valve seats. This first chamber communicates with the liquid inlet of the module. The second chamber may also be referred to as a recirculation passage with the second valve seat disposed about an entrance to that passage. Therefore, when the first valve member is disengaged from the first valve seat and second valve member is engaged with the second valve seat, the valve stem is in a dispensing mode or position. When the first valve member is engaged with the first valve seat and the second valve member is disengaged from the second valve seat, the valve stem is in a recirculating mode or position with liquid flowing from the liquid inlet, past the second valve seat, and into the recirculation passage or chamber of the module body. The module body includes a further recirculation passage communicating with the recirculation passage or chamber defined by the main passage. The liquid inlet and the recirculation passage or passages of the module body each communicate with one side of the module body, for example, to allow attachment to a liquid and air distribution manifold.

In a preferred embodiment, the valve stem is rounded at one end to form the first valve member and the second valve member is a section of the valve stem having an increased diameter relative to an adjacent section. A piston is connected with the valve stem and communicates with a pressurized air inlet port. When pressurized air is introduced against the piston, the first valve member moves out of engagement with the first valve seat and, simultaneously, the second valve member moves into engagement with the second valve seat. In this embodiment, a spring return mechanism is also connected with the valve stem for urging the first valve member into engagement with the first valve seat and simultaneously moving the second valve member out of engagement with the second valve seat. This occurs when the pressurized air introduced against the piston is sufficiently reduced or turned off. Alternatively, an air-over-air piston assembly may be utilized in which pressurized air is used on each side of the piston to move the valve stem in opposite directions. Also in the preferred embodiment, a pressurized air inlet port may communicate with a space adjacent to the liquid outlet for discharging pressurized air at liquid being dispensed from the liquid outlet. This air inlet port may also communicate with the same side of the module body as the liquid inlet and recirculation passage. The second valve seat may be formed as part of a spring-load seal assembly or other type of seal assembly that prevents liquid from leaking into the recirculation passage when the module is in a dispensing mode.

The present invention further contemplates apparatus for dispensing and recirculating liquid including a liquid reservoir, a supply pump connected with the liquid reservoir, and a manifold for receiving pressurized liquid from the supply pump. The manifold includes a liquid supply passage and a liquid recirculation passage, as well as a plurality of dispensing modules as generally described above. Metering gear pumps may also be connected with the manifold to meter precise amounts of liquid, such as hot melt adhesive, through the manifold and into the dispensing modules. When one or more dispensing modules are in a recirculating mode, the liquid may, for example, be pumped by the supply pump into the liquid supply passage of the manifold and then through a metering gear pump to the liquid inlet of the module. As the module will be in a non-dispensing, recirculating mode, this liquid will travel past the second valve seat and into the recirculation passages in the module and manifold and back to the supply pump. This flow path will continue until the dispenser module is placed into a dispensing mode by movement of the valve stem away from the first valve seat. In this dispensing mode, liquid will be pumped by the supply pump into the liquid supply passage of the manifold, through the metering gear pump, into the liquid inlet of the module and through the liquid outlet past the first valve seat.

The invention further contemplates methods of alternately dispensing and recirculating liquid including the steps of supplying pressurized liquid to a main passage within a dispenser and moving a valve stem within the main passage in a first direction along an axis to open a liquid discharge outlet extending along the axis and to close a recirculation passage within the dispenser to direct pressurized liquid through the discharge outlet. This may be followed by moving the valve stem in a second, opposite direction along the axis to close the liquid discharge outlet and open the recirculation passage within the dispenser to direct the pressurized liquid through the recirculation passage. Preferably, the liquid comprises hot melt adhesive and the valve stem is moved in the first direction by introducing pressurized air against a piston member connected with the valve stem, and moved in the second direction by a spring return mechanism. The step of moving the valve stem in the first direction includes disengaging a first end of the valve stem from a valve seat disposed about the liquid discharge outlet and includes engaging an intermediate portion of the valve stem against a second valve seat which surrounds an entrance to the recirculation passage, such as generally described above.

From the foregoing summary and the description to follow, it will be appreciated that the invention significantly reduces the components and parts typically used in dispensing and recirculation systems. Additional advantages and objectives of the invention will become more readily apparent of those of ordinary skill upon review of the following detailed description of a preferred embodiment, taken in conjunction with the accompanying drawings.

DETAILED DESCRIPTION OF THE PREFERRED EMBODIMENT

Figure 1:
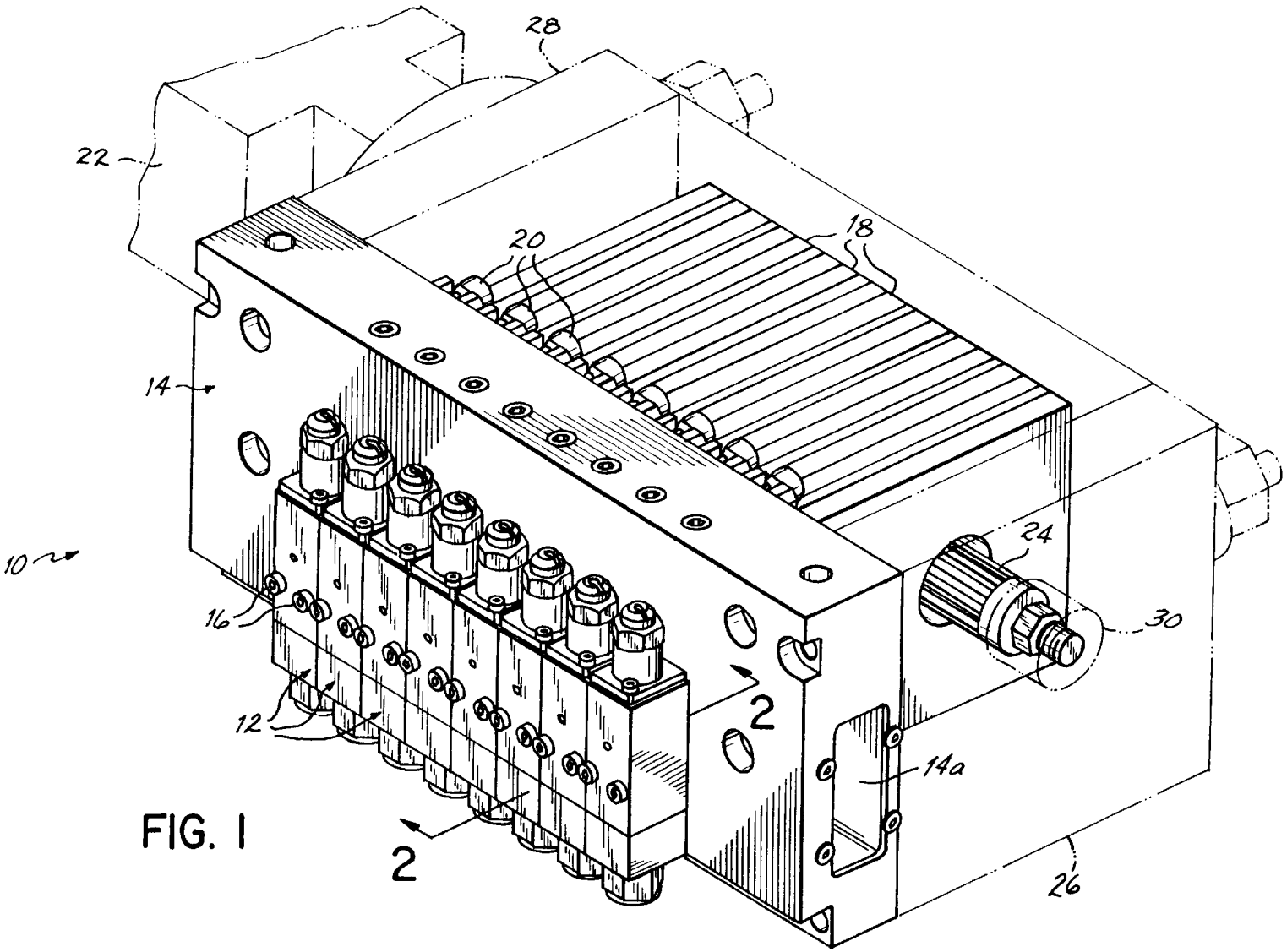
FIG. 1 is a perspective view of liquid dispensing apparatus incorporating dispensing modules constructed in accordance with the invention.

Referring first to FIG. 1, a liquid dispensing and recirculation apparatus 10 is shown specifically adapted for dispensing a heated liquid onto a substrate in accordance with principles of this invention. While it will be understood that any desired liquid, such as heated liquids, may be dispensed in accordance with the invention, for the sake of simplicity, the present invention will be described more specifically in connection with dispensing so-called hot melt adhesives. These adhesives are typically dispensed at about 250° F. and above. The inventive principles will be described with reference to only one of many possible embodiments of dispensing apparatus and dispensing module configurations falling within the scope of this invention.

Still referring to FIG. 1, apparatus 10 generally includes a plurality of dispensing modules or guns 12 constructed in accordance with the invention as will be described further below. These modules 12 are mounted to a liquid and air distribution manifold 14 by fasteners 16. Also, a corresponding plurality of gear pumps 18 may be mounted to an opposite side of manifold 14 using fasteners 20 and additional lower fasteners (not shown). Gear pumps 18 meter precise amounts of liquid hot melt adhesive through each module 12. A system similar to this is described and covered in U.S. patent application Ser. No. 08/685,070, the disclosure of which is fully incorporated by reference herein. As will be understood from a description of FIGS. 2 and 3 to follow, each gear pump 18 is in fluid communication with one module 12. Gear pumps 18 are operated by a motor 22 having an output (not shown) connected with a splined shaft 24 which rotates drive gears associated with each gear pump 18. Air and liquid distribution blocks 26, 28 may be mounted to manifold 14, in a conventional manner, for supplying pressurized air and liquid into manifold 14. An inlet block 26 may contain a filter (not shown) for filtering the liquid before it reaches manifold 14. These blocks 26, 28 may include appropriate bearings or bushings 30, (only one being shown in FIG. 1), for receiving shaft 24 and/or the motor output shaft (not shown) for rotation.

As is generally known in the art, manifold 14 may include a suitable cavity 14*a* for receiving a plug or cordset used to connected to the various heater pins, RTD pins, ground pin and any solenoid pins associated with manifold 14.

Figure 2:
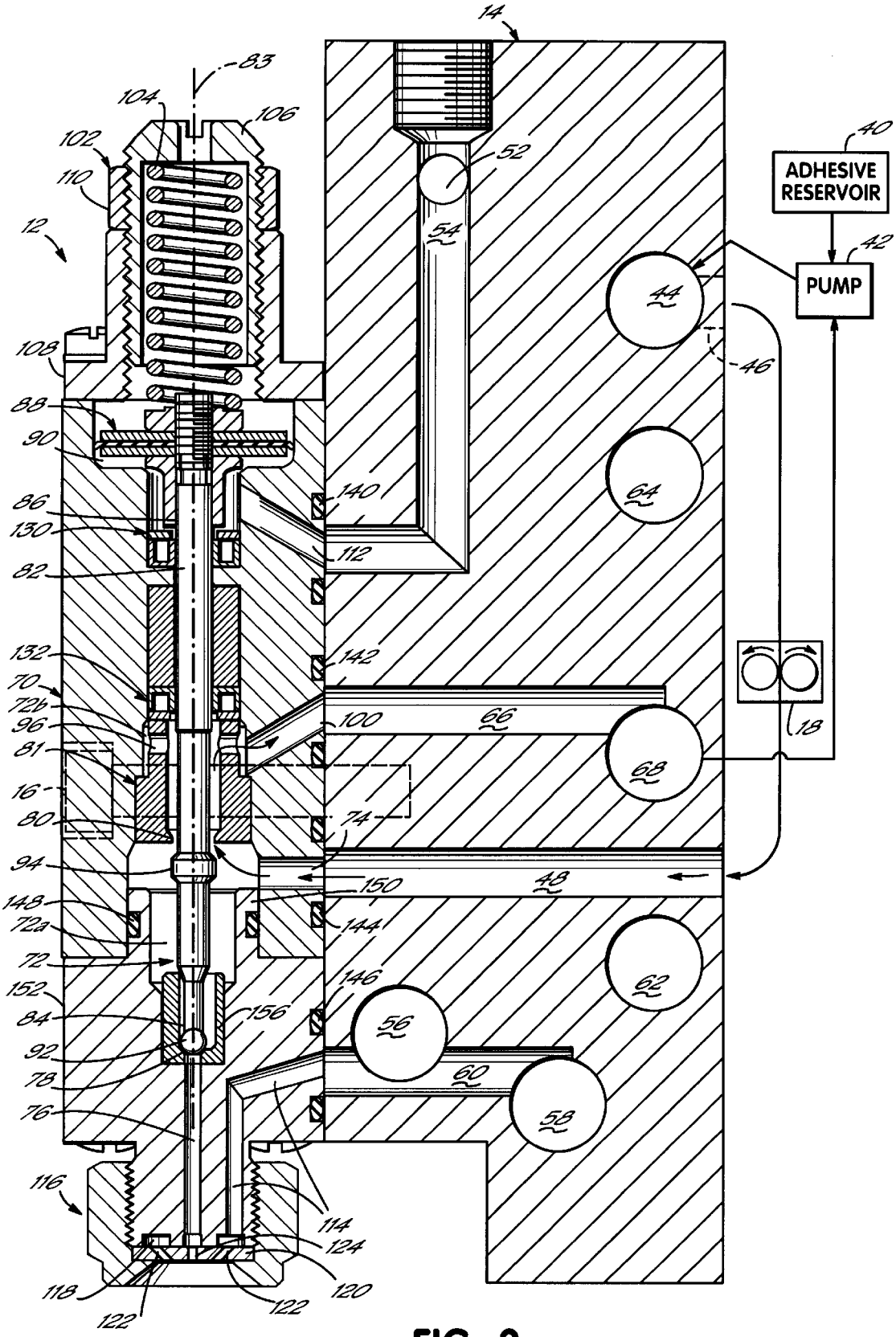
FIG. 2 is a cross sectional view of the dispensing module and manifold taken generally along line 2—2 of FIG. 1 and showing other components in block diagram format, with the module in a recirculation mode.

Referring now to FIG. 2, the internal structure and components of dispensing module 12 and manifold 14 are shown with module 12 being in a closed position. Also, an adhesive reservoir 40 and adhesive pump 42 are shown schematically connected with manifold 14. For clarity, the air and liquid distribution blocks 26, 28 have been eliminated from this figure. Manifold 14 includes a main liquid supply passage 44 communicating with an outlet of pump 42 and a series of distribution passages 46, each respectively being associated with one gear pump 18 and a corresponding dispensing module 12. It will be appreciated that this description applies equally to each module 12 and its corresponding gear pump 18. Specifically, distribution passage 46 leads into gear pump 18, as schematically shown, and an outlet of gear pump 18 communicates with a module supply passage 48 in manifold 14. Manifold 14 may include a main air supply passage 52 connected with a series of distribution passages 54 (only one being shown in the drawings) each being associated with a respective dispensing module 12. This supply passage 52 may also be eliminated and, in this case, each passage 54 is separately connected to a pressurized air source. Air supply passages 56, 58 are provided in manifold 14 and connect with a series of distribution passages 60 (only one being shown in the drawings) each corresponding to a respective dispensing module 12. These distribution passages 60 supply pressurized air to be used as pattern air for inducing a particular dispensed pattern of adhesive from module 12. An additional pair of passages 62, 64 may contain electric heating elements or rods for heating the liquid and pattern air in manifold 14 in a conventional manner. Finally, manifold 14 further includes a series of recirculation passages 66 (only one being shown in the drawings), each corresponding with a specific dispensing module 12 and communicating with a main recirculation passage 68 which leads back to pump 42 in a recirculation loop as schematically shown.

As further shown in FIG. 2, dispensing module 12 generally includes a module body 70 including a main passage 72 comprising sections or chambers 72*a*, 72*b*. As will be understood from the description to follow, section 72*a* may be considered as a supply passage or chamber, while chamber 72*b* may be considered a recirculation passage. Other designs for these passages will also fall within the spirit and scope of this invention. Module body 70 further includes a liquid inlet 74 and a liquid outlet 76. A first valve seat 78 is disposed upstream of liquid outlet 76 and a second valve seat 80 is disposed on a valve seat member 81 upstream of first valve seat 78 and generally between supply passage or chamber 72*a* and recirculation passage or chamber 72*b*. A valve stem 82 is mounted for reciprocating movement along an axis 83 and includes a first end 84 and a second end 86. A piston assembly 88 is mounted to second end 86 within an air chamber 90, while first end 84 includes a ball-shaped or rounded valve member 92. It will be appreciated that this valve member may take on many forms, including more tapered or needle-like forms. A second valve member 94 formed as a radially outward projection on valve stem 82 is positioned generally between first end 84 and second end 86 to engage second valve seat 80. When second valve member 94 is disengaged from second valve seat 80, first valve member 92 will be engaged with first valve seat 78. Therefore, any liquid flowing through inlet 74 will flow into chamber portion 72*a* past valve member 94 and second valve seat 80, and into recirculation chamber or passage 72*b* through a series of radial passages 96 in valve seat member 81. From this chamber 72*b*, the liquid will exit module body 70 through a second recirculation passage 100 in module body 70 communicating with passages 66, 68 of manifold 14.

Module 12 further includes a spring return mechanism 102 including a coil spring 104 and an adjustment member 106 mounted within a module body portion 108. Adjustment member 106 is threaded into module body portion 108 to allow adjustment of the spring force applied by coil spring 104 to urge valve stem 82 to the position shown in FIG. 2. A lock nut 110 is provided for locking the position of adjustment member 106. Module body 70 and body portion 152 have respective air inlet ports 112, 114. Air inlet port 112 connects with air distribution passage 54 of manifold 14 to allow the introduction of pressurized air into chamber 90 below piston assembly 88. This urges piston assembly 88 and valve stem 82 upward to the position shown in FIG. 3, as will be further described below. Air inlet port 114 connects with passage 60 of manifold 14 for allowing the introduction of pressurized air into a nozzle portion 116 of dispensing module 12. Specifically, air inlet port 114 communicates with an annular recess 118 disposed above a disc 120. Disc 120 includes a plurality of air discharge orifices 122 surrounding a liquid discharge orifice 124 which communicates with liquid outlet 76. As is conventional, air directed through orifices 122 can create a specific pattern of dispensed liquid, such as a swirled pattern.

As further shown in FIG. 2, various additional components of dispensing module 12 include an air seal 130 and a liquid seal 132 each disposed about valve stem 82. Air seal 130 prevents air leakage from chamber 90, while liquid seal assembly 132 prevents liquid from leaking out of recirculation chamber or passage 72*b*. Valve seat member 81 is press fit within module 70 and prevents leakage of liquid from chamber portion or section 72*a* into chamber 72*b*, except when second valve member 94 is disengaged from second valve seat 80 while in the recirculation position shown in FIG. 2. A series of o-rings 140, 142, 144, 146 seal module body 70 against manifold 14 and prevent leakage of air or liquid, as will be appreciated from FIG. 2. An additional o-ring 148 is disposed about a neck 150 associated with a separate module body portion 152. Also, although not necessary, first valve seat 78 may be formed as part of a separate seat member 156 which is press-fit into module body portion 152 as shown. It will be understood that many module or dispensing gun configurations can be used when carrying out this invention.

In operation, heated liquid adhesive is pumped from reservoir 40 by pump 42 into main supply passage 44. Motor 22 rotates the gears associated with gear pumps 18 and this meters fluid from passage 44 through distribution passage 46 and into module supply passage 48. From passage 48, the heated liquid adhesive enters liquid inlet 74 of module body 70 at chamber portion or section 72*a*. In the position shown in FIG. 2, pressurized air to passage 54 has been turned off. Thus, spring return mechanism 102 has urged valve stem 82 to the closed position shown with first valve member 84 engaging first valve seat 78. Thus, the liquid entering chamber portion 72*a* must travel past second valve member 94 and second valve seat 80 into recirculation chamber or passage 72*b*, and into recirculation passage 100 to exit module body 70. This liquid enters recirculation passage 66 and main recirculation passage 68 of manifold 14. From here, the liquid is returned to the inlet of pump 42, or alternatively into reservoir 40 where it may repeat the recirculation cycle.

Figure 3:
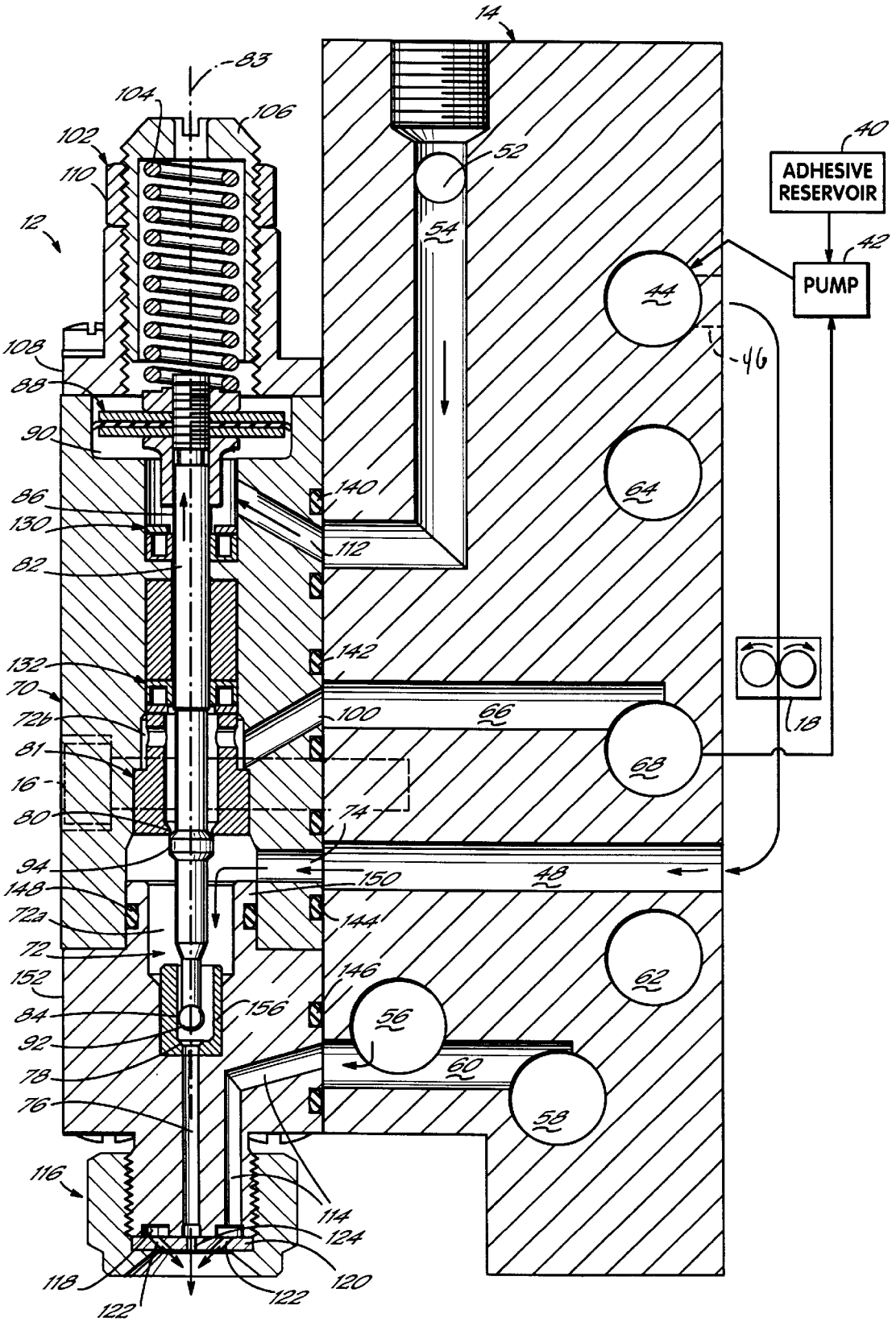
FIG. 3 is a cross sectional view similar to FIG. 2, but showing the dispensing module in a dispensing mode.

When pressurized air is supplied through passages 52, 54 of manifold 14, as shown in FIG. 3, this will move piston assembly 88, as well as the attached valve stem 82 upwardly as shown in the drawing against the force of spring 104. This raises first valve member 92 from first valve seat 78 and engages second valve member 94 with second valve seat 80. Thus, the liquid adhesive being supplied to supply passage 48 by gear pump 18 can no longer travel past second valve member 94 and second valve seat 80, but must instead travel past first valve member 92 and first valve seat 78 into liquid outlet 76. This liquid will exit dispenser module 12 at liquid discharge outlet or orifice 124 and, if pressurized air is introduced into air inlet port 114 and through orifices 122, a swirled pattern of adhesive may be discharged from nozzle portion 116.

While the present invention has been illustrated by a description of various preferred embodiments or features and while these embodiments and features have been described in considerable detail in order to describe the best mode of practicing the invention, it is not the intention of Applicants to restrict or in any way limit the scope of the appended claims to such detail. Additional advantages and modifications within the spirit and scope of the invention will readily appear to those skilled in the art. The invention itself should only be defined by the appended claims, wherein

We claim:

1. A liquid dispensing module for alternately dispensing and recirculating liquid, the module comprising:

a module body including a main passage extending along an axis, said module body further including a liquid inlet, a recirculation passage and a liquid outlet, said liquid outlet extending generally along said axis at one end of said main passage, first and second valve seats disposed in said main passage, said first valve seat being disposed generally between said liquid inlet and said liquid outlet and said second valve seat being disposed generally between said liquid inlet and said recirculation passage, and a valve stem having first and second ends and mounted for reciprocating movement within the main passage along said axis and including first and second valve members, said valve stem being movable between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation passage.

2. The module of claim 1, wherein the first end of said valve stem is rounded to form said first valve member and said second valve member is a section of said valve stem having an increased diameter relative to an adjacent section of said valve stem.

3. The module of claim 1 further comprising a piston connected with said valve stem and communicating with a pressurized air inlet port for moving said first valve member out of engagement with said first valve seat and simultaneously moving said second valve member into engagement with said second valve seat.

4. The module of claim 1 further comprising a spring return mechanism connected with said valve stem for urging said first valve member into engagement with said first valve seat and simultaneously moving said second valve member out of engagement with said second valve seat.

5. The module of claim 1 further comprising an air inlet port communicating with a space adjacent said liquid outlet for discharging pressurized air at liquid being dispensed from said liquid outlet.

6. The module of claim 5, wherein said liquid inlet, recirculation passage and air inlet port each communicate with one side of said module body.

7. The module of claim 1, wherein said liquid inlet and said recirculation passage each communicate with one side of said module body.

8. A module for alternately dispensing and recirculating liquid, the module comprising:

a module body including a main passage separated into a liquid recirculation portion and a liquid supply portion, and including a liquid inlet and a liquid outlet communicating with said liquid supply portion, first and second valve seats disposed in axial alignment with each other in said main passage, said first valve seat disposed about an entrance to said liquid outlet and said second valve seat disposed about an entrance to said liquid recirculation portion of said main passage, and a valve stem including a first valve member and a second valve member, said valve stem mounted for reciprocating movement between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation portion of said main passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation portion of said main passage.

9. The module of claim 8, wherein one end of said valve stem is rounded and forms said first valve member and said second valve member is a section of said valve stem having an increased diameter relative to an adjacent section of said valve stem.

10. The module of claim 8 further comprising a piston connected with said valve stem and communicating with a pressurized air inlet port for moving said first valve member out of engagement with said first valve seat and simultaneously moving said second valve member into engagement with said second valve seat.

11. The module of claim 8 further comprising a spring return mechanism connected with said valve stem for urging said first valve member into engagement with said first valve seat and simultaneously moving said second valve member out of engagement with said second valve seat.

12. The module of claim 8 further comprising an air inlet port communicating with a space adjacent said liquid outlet for discharging pressurized air at liquid being dispensed from said liquid outlet.

13. The module of claim 12, wherein said liquid inlet, said recirculation portion of said main passage and said air inlet port each communicate with one side of said module body.

14. A module for alternately dispensing and recirculating liquid, the module comprising:

a module body including first and second liquid chambers, said first chamber including first and second valve seats and a liquid inlet, said first valve seat defining an entrance to a liquid outlet in the module body and said second valve seat defining an entrance to said second liquid chamber, a valve stem mounted for reciprocating movement in said first and second chambers and including first and second valve members respectively engageable with said first and second valve seats, and a recirculation passage extending from an outside surface of said module body to said second liquid chamber, wherein said valve stem is movable between a dispensing position in which liquid can flow from said liquid inlet through said first chamber and into said liquid outlet and a recirculating position in which liquid can flow from said liquid inlet through said first and second chambers and into said recirculation passage.

15. Apparatus for dispensing and recirculating liquid comprising:

a pressurized liquid supply;

a manifold operatively coupled with said pressurized liquid supply and including a liquid supply passage and a liquid recirculation passage, and a plurality of dispensing modules connected to said manifold, wherein each module includes:

i) a module body including a main passage extending along an axis, said module body further including a liquid inlet, a recirculation passage and a liquid outlet, said liquid outlet extending generally along said axis at one end of said main passage, ii) first and second valve seats disposed in said main passage, said first valve seat being disposed generally between said liquid inlet and said liquid outlet and said second valve seat being disposed generally between said liquid inlet and said recirculation passage, and iii) a valve stem having first and second ends and mounted for reciprocating movement within the main passage along said axis and including first and second valve members, said valve stem being movable between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation passage.

16. The apparatus of claim 15, wherein the first end of said valve stem is rounded to form said first valve member and said second valve member is a section of said valve stem having an increased diameter relative to an adjacent section of said valve stem.

17. The apparatus of claim 15, further comprising a piston connected with said valve stem and communicating with a pressurized air inlet port for moving said first valve member out of engagement with said first valve seat and simultaneously moving said second valve member into engagement with said second valve seat.

18. The apparatus of claim 15 further comprising a spring return mechanism connected with said valve stem for urging said first valve member into engagement with said first valve seat and simultaneously moving said second valve member out of engagement with said second valve seat.

19. The apparatus of claim 15 further comprising an air inlet port communicating with a space adjacent said liquid outlet for discharging pressurized air at liquid being dispensed from said liquid outlet.

20. The apparatus of claim 19, wherein said liquid inlet, recirculation passage and air inlet port each communicate with one side of said module body.

21. The apparatus of claim 15, wherein said liquid inlet and said recirculation passage each communicate with one side of said module body.

22. Apparatus for alternately dispensing and recirculating liquid, the apparatus comprising:

a pressurized liquid supply;

a manifold operatively coupled with said pressurized liquid supply and including a liquid supply passage and a liquid recirculation passage, and a plurality of dispensing modules connected to said manifold, wherein each module includes:

i) a module body including a main passage separated into a liquid recirculation portion and a liquid supply portion, and including a liquid inlet and a liquid outlet communicating with said liquid supply portion, ii) first and second valve seats disposed in axial alignment with each other in said main passage, said first valve seat disposed about an entrance to said liquid outlet and said second valve seat disposed about an entrance to said liquid recirculation portion of said main passage, and iii) a valve stem including a first valve member and a second valve member, said valve stem mounted for reciprocating movement between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation portion of said main passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation portion of said main passage.

23. The apparatus of claim 22, wherein the first end of said valve stem is rounded to form said first valve member and said second valve member is a section of said valve stem having an increased diameter relative to an adjacent section of said valve stem.

24. The apparatus of claim 22 further comprising a piston connected with said valve stem and communicating with a pressurized air inlet port for moving said first valve member out of engagement with said first valve seat and simultaneously moving said second valve member into engagement with said second valve seat.

25. The apparatus of claim 22 further comprising a spring return mechanism connected with said valve stem for urging said first valve member into engagement with said first valve seat and simultaneously moving said second valve member out of engagement with said second valve seat.

26. The apparatus of claim 22 further comprising an air inlet port communicating with a space adjacent said liquid outlet for discharging pressurized air at liquid being dispensed from said liquid outlet.

27. The apparatus of claim 26, wherein said liquid inlet, said recirculation portion of said main passage and said air inlet port each communicate with one side of said module body.

28. The apparatus of claim 22, wherein said liquid inlet and said recirculation portion of said main passage each communicate with one side of said module body.

29. Apparatus for alternatively dispensing and recirculating liquid comprising:

a pressurized liquid supply;

a manifold operatively coupled with said pressurized liquid supply and including a liquid supply passage and a liquid recirculation passage, and a plurality of dispensing modules connected to said manifold, wherein each module includes:

i) a module body including first and second liquid chambers, said first chamber including first and second valve seats and a liquid inlet, said first valve seat defining an entrance to a liquid outlet in the module body and said second valve seat defining an entrance to said second liquid chamber, ii) a valve stem mounted for reciprocating movement in said first and second chambers and including first and second valve members respectively engageable with said first and second valve seats, and iii) a recirculation passage extending from an outside surface of said module body to said second liquid chamber, iv) wherein said valve stem is movable between a dispensing position in which liquid can flow from said liquid inlet through said first chamber and into said liquid outlet and a recirculating position in which liquid can flow from said liquid inlet through said first and second chambers and into said recirculation passage.

30. A method of alternately dispensing and recirculating liquid within a dispenser comprising a module body having a main passage communicating with a liquid inlet, a liquid discharge passage, and a recirculation passage, and having a valve stem mounted for reciprocating movement along a common axis of said main passage and said liquid discharge passage, the method comprising:

supplying pressurized liquid to said main passage from said liquid inlet, moving said valve stem within said main passage in a first direction along said axis to allow communication between said liquid discharge passage, said main passage, and said liquid inlet and to close said recirculation passage relative to said liquid inlet thereby directing said pressurized liquid through said liquid discharge passage, and moving said valve stem in a second, opposite direction along said axis to close said liquid discharge passage and open said recirculation passage thereby directing said pressurized liquid from said liquid inlet through said main passage and said recirculation passage.

31. The method of claim 30, wherein said liquid further comprises hot melt adhesive.

32. The method of claim 30, wherein said valve stem is moved in said first direction by introducing pressurized air against a piston member connected with said valve stem.

33. The method of claim 32, wherein said valve stem is moved in said second direction by a spring return mechanism connected with said valve stem.

34. The method of claim 30, wherein the step of moving said valve stem in said first direction includes disengaging a first end of said valve stem from a first valve seat disposed about said liquid discharge outlet.

35. The method of claim 34, wherein the step of moving said valve stem in said first direction includes engaging an intermediate portion of said valve stem against a second valve seat which surrounds an entrance to said recirculation passage.

36. A module for alternately dispensing and recirculating liquid, the module comprising:

a module body including a main passage separated into a liquid recirculation portion and a liquid supply portion, and including a liquid inlet and a liquid outlet communicating with said liquid supply portion, first and second valve seats disposed in said main passage, said first valve seat disposed about an entrance to said liquid outlet and said second valve seat disposed about an entrance to said liquid recirculation portion of said main passage, and a valve stem having a first end with a first valve member formed on said first end, and a second valve member formed as a section of said valve stem having an increased diameter relative to an adjacent section of said valve stem, said valve stem mounted for reciprocating movement between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation portion of said main passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation portion of said main passage.

37. A module for alternately dispensing and recirculating liquid, the module comprising:

a module body including a main passage separated into a liquid recirculation portion and a liquid supply portion, and including a liquid inlet and a liquid outlet communicating with said liquid supply portion, said liquid inlet and said recirculation portion of said main passage each communicating with one side of said module body, first and second valve seats disposed in said main passage, said first valve seat disposed about an entrance to said liquid outlet and said second valve seat disposed about an entrance to said liquid recirculation portion of said main passage, and a valve stem including a first valve member and a second valve member, said valve stem mounted for reciprocating movement between a dispensing position in which said first valve member is disengaged from said first valve seat to allow liquid flow from said liquid inlet into said liquid outlet and said second valve member is engaged with said second valve seat to prevent liquid flow from said liquid inlet into said recirculation portion of said main passage and a recirculating position in which said first valve member is engaged with said first valve seat to prevent liquid flow from said liquid inlet into said liquid outlet and said second valve member is disengaged from said second valve seat to allow liquid flow from said liquid inlet into said recirculation portion of said main passage.

* * * * *